US011028607B1

(12) United States Patent
D'Allaird et al.

(10) Patent No.: US 11,028,607 B1
(45) Date of Patent: Jun. 8, 2021

(54) SWIMMING POOL PERIPHERAL RECESS COVER FASTENER

(71) Applicant: Trojan Leisure Products, LLC, Albany, NY (US)

(72) Inventors: Brian K. D'Allaird, Ballston Lake, NY (US); Stephen E. Deeb, Schenectady, NY (US); Collin J. Sirco, Ballston Lake, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 0 days.

(21) Appl. No.: 16/420,639

(22) Filed: May 23, 2019

Related U.S. Application Data

(62) Division of application No. 15/406,224, filed on Jan. 13, 2017, now Pat. No. 10,301,835.

(51) Int. Cl.
*E04H 4/10* (2006.01)
*E04H 4/14* (2006.01)

(52) U.S. Cl.
CPC ..... *E04H 4/10* (2013.01); *E04H 4/144* (2013.01)

(58) Field of Classification Search
CPC .. E04H 4/08; E04H 4/10; E04H 4/108; E04H 4/144; E04H 4/06
USPC ..... 24/302, 503, 572.1; 4/503
See application file for complete search history.

(56) References Cited

U.S. PATENT DOCUMENTS 3,373,464 A * 3/1968 Ausnit ..... E04H 4/10 24/586.1
4,466,144 A 8/1984 Lamb
5,014,369 A 5/1991 Daus
5,282,282 A 2/1994 Shehan et al.
5,388,314 A * 2/1995 Vella ..... E04H 4/10 24/462
5,417,016 A 5/1995 Dahowski et al.
6,442,773 B1 9/2002 Kopyar et al.
7,517,577 B2 4/2009 Pedde
2005/0262626 A1* 12/2005 Lewis ..... E04H 4/10 4/498

(Continued)

FOREIGN PATENT DOCUMENTS

EP 779401 B1 3/2001

OTHER PUBLICATIONS

Radiant Pool Custom Delux Winter Covers, 2 pp., 2014.

(Continued)

*Primary Examiner* — J C Jacyna
(74) *Attorney, Agent, or Firm* — Tech Valley Patent, LLC; John Pietrangelo

(57) ABSTRACT

Swimming pool recess covers and methods of covering swimming pool recesses, for example, stairwells, are disclosed. The recess covers include a flexible sheet adapted to at least partially cover the recess, and one or more fasteners mounted to an edge of the sheet. The fasteners are adapted to engage a main pool cover. The fastener may be an elongated fastener having a receptacle adapted to receive a projection mounted on the main pool cover. The receptacle may have an opening defined by opposing arms adapted to deflect when contacted by the projection on the main cover. The flexible arms may also include projections that enhance engagement of the receptacle with the projection on the main pool cover. Swimming pool peripheral recess cover fasteners are also provided.

20 Claims, 4 Drawing Sheets

(56) References Cited

U.S. PATENT DOCUMENTS

| | | | | |
|---|---|---|---|---|
| 2007/0062012 | A1 | 3/2007 | Caison | |
| 2009/0235496 | A1* | 9/2009 | Baum | B60P 3/343 24/458 |
| 2010/0154110 | A1 | 6/2010 | Clermont | |
| 2012/0073039 | A1 | 3/2012 | Hotaling | |
| 2013/0298325 | A1* | 11/2013 | Preuit | E04H 4/10 4/498 |
| 2019/0003200 | A1* | 1/2019 | Ming | E04H 4/105 |

OTHER PUBLICATIONS

Office Action issued for parent U.S. Appl. No. 15/406,224 dated Nov. 27, 2017, 6 pages.
Office Action issued for parent U.S. Appl. No. 15/406,224 dated Feb. 2, 2018, 13 pages, with list of references cited.
Office Action issued for parent U.S. Appl. No. 15/406,224 dated Jun. 29, 2018, 9 pages.
Office Action issued for parent U.S. Appl. No. 15/406,224 dated Oct. 15, 2018, 10 pages, with list of references cited.
Office Action issued for parent U.S. Appl. No. 15/406,224 dated Feb. 8, 2019, 8 pages, with list of references cited.

* cited by examiner

SWIMMING POOL PERIPHERAL RECESS COVER FASTENER

CROSS-REFERENCE TO RELATED APPLICATION

This application is a divisional application of and claims priority from pending U.S. patent application Ser. No. 15/406,224, filed on Jan. 13, 2017, now U.S. Pat. No. 10,301,835, the disclosure of which is included by reference herein in its entirety.

BACKGROUND OF THE INVENTION

Technical Field

The invention generally concerns swimming pool covers. In particular, the invention provides covers for peripheral recesses in swimming pools, for example, for stair assemblies. The covers and methods disclosed facilitate pool installation and minimize or eliminate delays due to the acquisition of specially designed pool covers.

Description of Related Art

The popularity and common appearance of swimming pools, among other things, reflects the continuous improvements made by pool suppliers in reducing cost and enhancing the enjoyment of inground and above ground swimming pools. In some pool installations, for example, those in northern climates, swimming pools are typically protected during cooler months with what are referred to as "winter covers."

Though taking many forms, winter covers are typically water-impermeable plastic sheets adapted to be mounted over a pool and protect the pool and the water it contains from inclement weather, snow, leaves, and animals, among other things.

Historically, winter covers have been effective means for protecting a pool. However, with the increasing popularity of auxiliary pool structures that enhance the pool experience, for example, stairwells and/or other recesses within the periphery of the pool, the fabrication and installation of winter covers can be problematic. Specifically, with the addition of such peripheral recesses, the conformity of the recesses to the conventionally shaped pool covers, for example, round, oval, or rectangular, can be compromised.

According to the existing art, covering peripheral recesses, such as, stairwells, requires the fabrication of uniquely designed pool covers having external "flaps" or covers that cover and protect the recess. The cost and availability of such specially designed pool covers may not only increase the cost of a pool but may also interfere with the pool installation process.

Aspects of the present invention were conceived and developed to over come these and other disadvantages of the prior art.

SUMMARY OF THE INVENTION

Aspects of the present invention provide swimming pool peripheral recess covers, methods for covering peripheral recesses in a swimming pool, and swimming pool peripheral recess cover fasteners that over come the issues and disadvantages associated with prior art covers and methods.

One embodiment of the invention is a swimming pool peripheral recess cover comprising or including: a flexible sheet adapted to at least partially cover the peripheral recess, the flexible sheet having a plurality of edges; and a fastener mounted to at least one of the plurality of edges, the fastener adapted to releasably engage a main pool cover. In one aspect, the peripheral recess comprises a stairwell or stair assembly.

In one aspect, the fastener comprises at least one elongated fastener, and the at least one elongated fastener includes a recess adapted to engage a projection on the main pool cover or a projection adapted to engage a recess on the main cover. For example, the elongated fastener may include a receptacle adapted to receive a projection mounted to the main cover. The fastener receptacle may include an opening defined by opposing arms, for example, flexible opposing arms adapted to deflect when contacted by the projection on the main cover. The opposing arms may further include a projections or ribs adapted to engage the projection on the main cover.

Another embodiment of the invention is a method for at least partially covering a peripheral recess in a swimming pool, the method comprising or including: providing a flexible sheet adapted to at least partially cover the peripheral recess, the flexible sheet having a plurality of edges and a fastener mounted to at least one of the plurality of edges; installing a main cover on the swimming pool; installing the flexible sheet at least partially over the peripheral recess; and engaging the fastener on the flexible sheet to the main cover. In one aspect, the peripheral recess covered by the process is a stairwell or stair assembly.

In another aspect of the method, the fastener may include a receptacle having an opening and wherein the main cover comprises a projection or "bead," wherein the step of engaging the fastener on the flexible sheet to the main cover may be practiced by inserting the projection or bead of the main cover into the opening of the receptacle of the fastener on the flexible sheet. In another aspect, the opening of the receptacle may be defined by opposing flexible arms, and the practice of inserting the projection into the opening may comprise deflecting the flexible arms by contacting at least one of the flexible arms with the projection or bead. In a further aspect, the flexible arms may each comprise a projection or rib, and the method may further comprise retaining the main cover projection or bead within the receptacle by engaging a projection on at least one of the flexible arms with a surface on the projection or bead of the main cover.

A further embodiment of the invention is swimming pool peripheral recess cover fastener comprising or including: an elongated receptacle adapted to mounted to a flexible sheet, the receptacle having an elongated opening defined by opposing elongated flexible arms and an internal cavity in communication with the opening adapted to receive and retain a mating projection or "bead." In one aspect, the opposing elongated flexible arms of the fastener may comprise arms adapted to deflect when contacted by the mating projection or bead. In another aspect, the opposing arms of the fastener may include a projection or rib adapted to engage the mating projection or bead. In another aspect, the internal cavity of the fastener may include an internal surface having at least one rib adapted to contact the mating projection or bead and minimize rotation of the mating projection or bead. The mating projection or bead may be mounted on a main pool cover, and the fastener may be adapted to engage the mating projection or bead on the main pool cover to fasten the peripheral recess cover to the main pool cover.

These and other aspects, features, and advantages of this invention will become apparent from review of the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other features and advantages of the invention will be readily understood from the following detailed description of aspects of the invention taken in conjunction with the accompanying drawings in which:

DETAILED DESCRIPTION OF THE INVENTION

Figure 1:
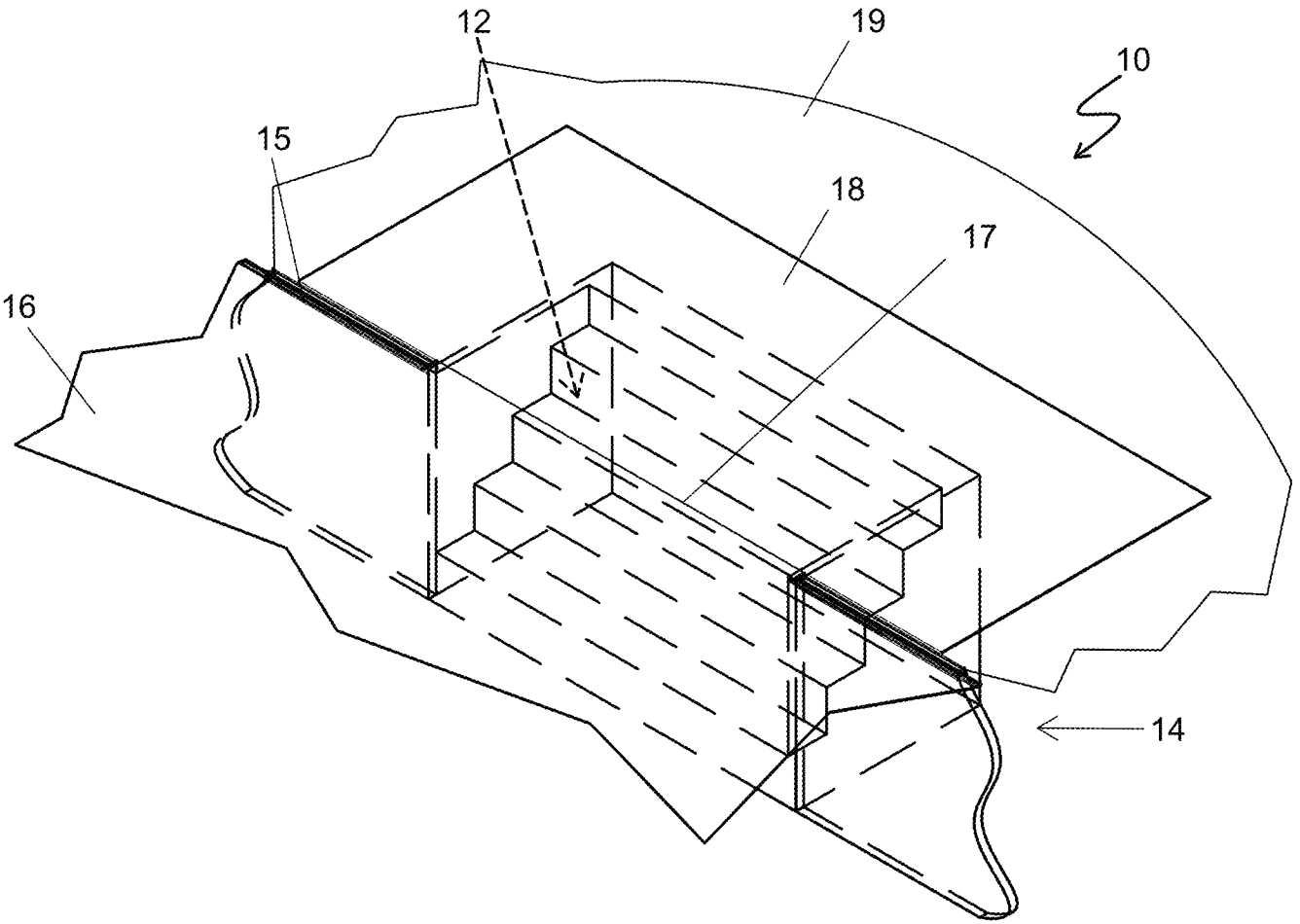
Figure 1 Prior Art
FIG. 1 is a partial perspective view of pool cover installation over a stair assembly according to the prior art.

FIG. 1 is a partial perspective view of a pool cover installation 10 over a stair assembly 12 of a pool 14 according to the prior art. As shown in FIG. 1, according to the prior art, when a pool cover 16 (only a representative portion of which is shown) is positioned over pool 14 (only a representative portion of which is shown), the cover 16 is typically provided by a conventional pool cover 16, for example, having a "stock" shape and dimensions to accommodate the standard size and shape of pool 14. For example, pool 14 may typically comprise a rectangular or circular shape, and conventional pool cover 16 may typically be stocked in sizes and shapes, again, for example, rectangular or circular, to fit over the conventionally shaped pool. Accordingly, without further modification, pool cover 16 would typically not cover stair assembly 12.

In conventional practice, when a stair assembly 12 or other recess is present in a pool, is to be covered, a specially designed stair assembly cover or "flap" 18 is typically provided to cover stair assembly 12 and at least partially cover adjacent pool deck 19. For example, in typical practice, a specially designed cover 16 having a flap 18 is provided. The flap 18 may typically be stitched to cover 16, for example, stitched along an edge 17, to provide an integral, specially designed cover 16/18 for pool 14 and stair assembly 12.

As is known in the art, the cover 16/18 may typically be mounted to the edge of pool 14, for example, mounted in a groove, track, or "bead receiver" in a coping 15 mounted on pool 14, for example, a coping provided by Radiant Pools of Albany N.Y. Flap 18 may be retained on the adjacent underlying deck or other surface 19 by conventional means, for example, via one or more straps or tie-downs, and/or with ballast, for example, one or more sand-filled bags or water-filled bags or containers. In addition, according to conventional practice, flap 18 does not engage cover 16 or coping 15 outside the extents of stair assembly 12, but flap 18 simply lies on deck 19 adjacent to coping 15 and/or cover 16, and, for example, held down by water bags.

However, it is recognized in the art that providing the specially designed cover 16 with flap 18 is not only costly to the pool cover provider and to the pool owner, but such a specially designed cover arrangement 10 can limit the installation procedure and hamper the installer. For example, the delivery time of a typically non-standard, specially-ordered cover 16 with integral flap 18 may undesirably be much longer than the delivery time of stock-size covers 16, and thus, without taking special precautions, delivery of specially designed cover 16 with integral flap 18 may interfere with the installation schedule of the installer and/or pool owner.

Recognizing the limitations and disadvantages of the prior art, the present inventors conceived and developed embodiments of the present invention, and their many aspects.

Figure 2:
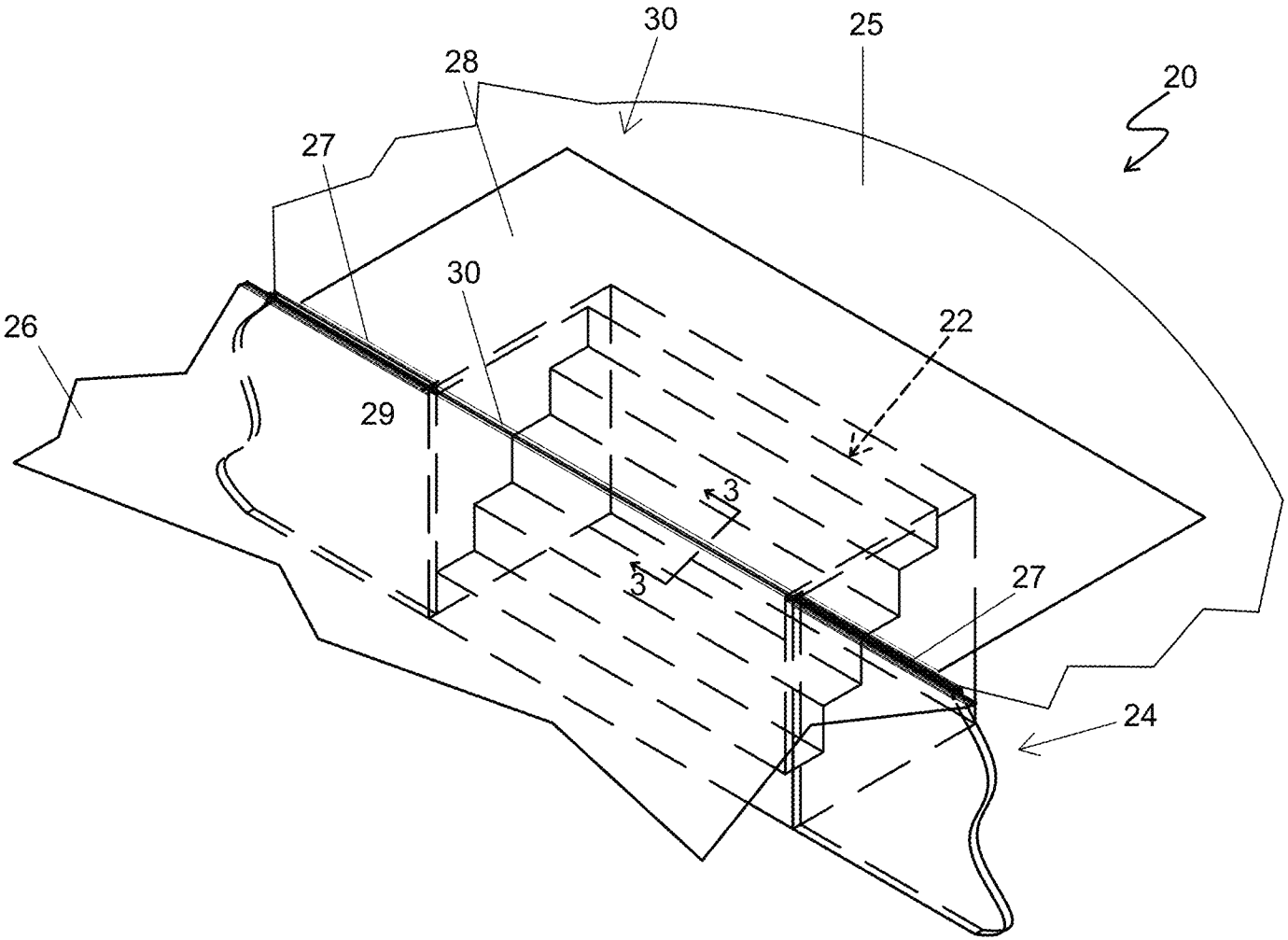
FIG. 2 is a partial perspective view of pool cover installation over a stair assembly according one aspect of the present invention.

FIG. 2 is a perspective view of pool cover installation arrangement 20 for a peripheral recess 22, such as, a stairwell or stair assembly 22, for example, a stair assembly similar to stair assembly 12 shown in FIG. 1, of a pool 24 (only a representative portion of which is shown) having an adjacent surface or deck 25 (only a representative portion of which is shown in FIG. 2) according one aspect of the present invention. According to aspects of the invention, peripheral recess 22 may comprise any structure associated with pool 24, for example, peripheral recess 22 may comprise a cavity, a bench, a wading pool, a hot tub, or a "swim-up" bar associated with pool 24. However, it is envisioned that aspects of the invention may be used for any other structure associated with any other cavity or depression having a recess, interruption, or cavity in its periphery or outer boundary for which protection or covering is desired. In the following discussion, peripheral recess 22 may be referred to as a "stairwell" or "stair assembly" to facilitate disclosure; however, such terms are not intended to in any way limit the scope or potential application of aspects of the invention.

As shown FIG. 2, arrangement 20 may typically include a pool cover 26, for example, a main pool cover, (only a representative portion of which is shown), for example, similar in function to cover 16 shown in FIG. 1, but, according to aspects of the invention, arrangement 20 also includes a smaller cover, auxiliary cover, panel, flexible sheet, or "flap" 28 adapted to cover stair assembly 22, or any similar recess in pool 24. The flap 28 typically includes a plurality of edges, for example, external extremities. Unlike prior art pool cover arrangements, according to aspects of the invention, panel 28 is not stitched to main cover 26; panel 28 is attached to main cover 26 by means of one or more fasteners 30, for example, one or more elongated fasteners 30, for instance, along edge 29 of panel 28.

The one or more fasteners 30 may be any conventional fasteners adapted to engage panel 28 with cover 26. However, according to one aspect of the invention, the one or more fasteners 30 may allow for ready or easy engagement and disengagement of panel 28—with/from cover 26. For example, one or more fasteners 30 may comprise mechanical fasteners, such as, threaded fasteners, or loop and hook type fasteners, such as, fasteners marketed under the name Velcro® hook and loop fasteners. Upon attachment of panel 28 to cover 26 by fasteners 30, panel 28 may be retained on deck 25 by conventional means, for example, with straps, tie-downs, or ballast (as disclosed herein), and cover 26 beyond the extremities of fasteners 30 may be retained by conventional means, for example, cover 26 may engage a groove, a track, or a bead receiver in a coping 27 mounted to pool 24.

Figure 3:
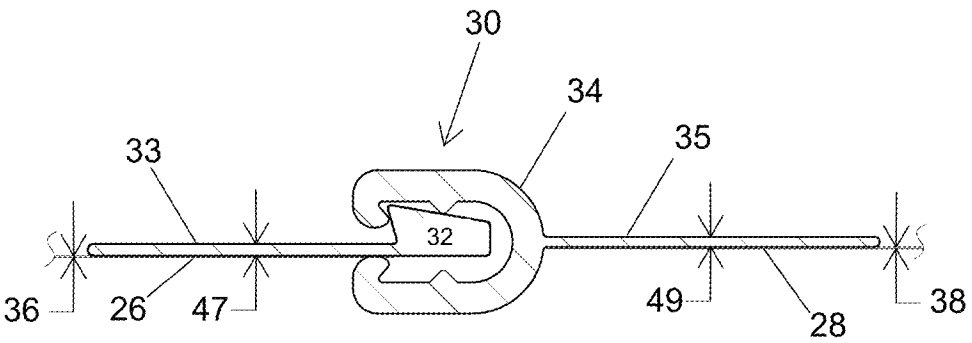
FIG. 3 is a cross-sectional view of the engagement of the cover arrangement shown in FIG. 2 as viewed along section lines 3-3 shown in FIG. 2 with the fastener engaged.
Figure 4:
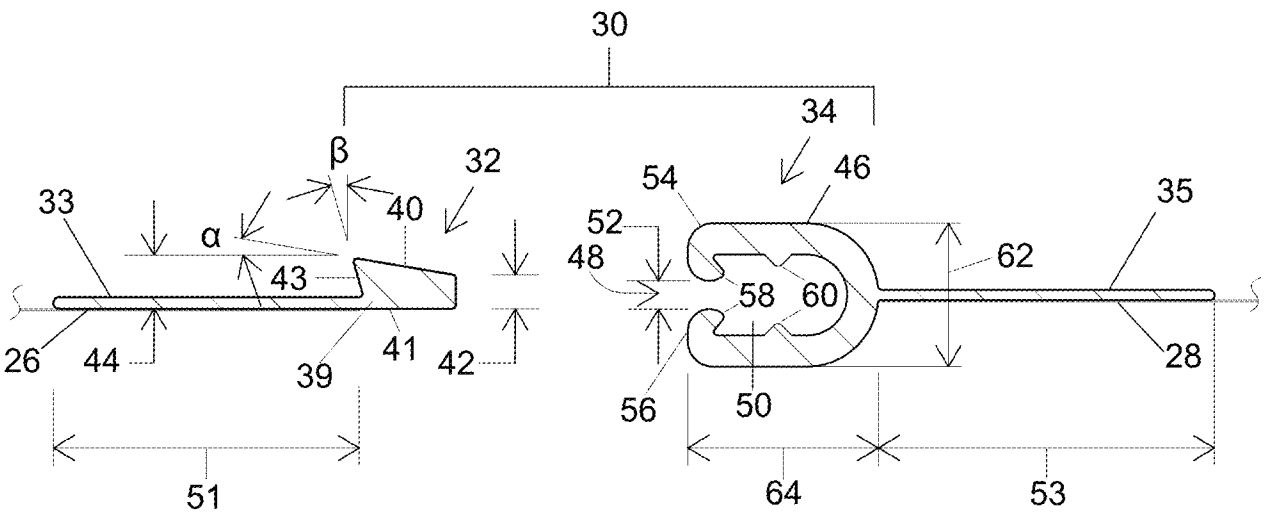
FIG. 4 is a cross-sectional view of the engagement of the fastener shown in FIG. 3 with the fastener disengaged.

According to one aspect of the invention, the one or more fasteners 30 may typically comprise one or more "male-female" type fasteners as shown in FIGS. 3 and 4.

FIG. 3 is a cross-sectional view of the engagement of panel 28 with cover 26 by means of one or more fasteners 30 of the cover arrangement 20 shown in FIG. 2, as viewed along section lines 3-3 in FIG. 2, according to an aspect of the invention. As shown in FIG. 3, connector 30 comprises a male-type projection or "bead" 32 having a flange 33 mounted to cover 26 and a female-type receptacle 34 having a flange 35 mounted to panel 28. It is envisioned that, in one aspect, male-type projection 32 may be mounted to panel 28 and female-type receptacle 34 may be mounted to cover 26. The mounting of projection 32 to cover 26 or panel 28 and the mounting of receptacle 34 on panel 28 or cover 26 may be conventional, for example, projection 32 and receptacle 34 may be molded into cover 26, or panel 28, respectively; flange 33 of projection 32 and flange 35 of receptacle 34 may be sewn onto cover 26, or panel 28, respectively; or attached by conventional fasteners.

Though aspects of the invention may be adapted for a broad range of thicknesses of cover 26 and panel 28, as shown in FIG. 3, cover 26 may have a thickness 36 and panel 28 may have a thickness 38 ranging from about 0.001 inches to about 1 inch, but are typically between about 0.001 inches and about 0.010 inches, for example, about 0.005 inches. Similarly, the thicknesses 47 and 49 of flanges 33 and 35, respectively, may vary broadly. In one aspect, thicknesses 47 and 49 may range from about 0.001 inches to about 1 inch, but are typically between about 0.025 inches and about 0.050 inches, for example, about 0.03125 [1/32] inches.

FIG. 4 is a cross-sectional view of the fastener 30 shown in FIG. 3 with projection 32 disengaged from receptacle 34 to facilitate illustration and description of this aspect of the invention. Projection 32 having flange 33 is sized and shaped to be received by respectable receptacle 34 and retained by receptacle 34, for example, retained without separating under the loading typically expected upon cover 26 and panel 28. As shown in FIG. 4, projection 32 may be an elongated projection having a body 39 having an upper surface 40 beveled at an angle $\alpha$ from the horizontal and a lower surface 41. In one aspect, projection 32 may comprise any of the conventional "bead" designs provided by contemporary pool liner providers, for example, provided by Proplastex Industries Inc. of Ontario, Canada. For example, in one aspect, projection 32 may comprise a "standard bead," for example, standard bead #1, 2, 3, 4, 5, 6, 7, or 8. As also shown in FIG. 4, flange 33 may have a length 51 ranging from about 0.25 inches to about 3 feet, but length 51 is typically between about 0.50 inches and about 2 inches, for example, about 1 inch.

Though in FIG. 4 lower surface 41 is shown substantially planar, for example, coplanar with the lower surface of cover 26, in one aspect, lower surface 41 may be beveled, that is, in lieu of the bevel of upper surface 40 or where both surfaces 40 and 41 are beveled. The beveled surface 40 may vary the thickness of body 39 of projection 32 from a front thickness 42 to a rear thickness 44. Angle $\alpha$ of surface 40 may range from about 0 degrees to about 30 degrees, but typically may be about 10 degrees.

The front edge of projection 32 may be planar, as shown, or radiused. Front thickness 42 may range from about 0.03125 [1/32] inches to about 0.5 [1/2] inches, but front thickness 42 may typically be about 0.1625 [1/16] inches. Rear thickness 44 may range from about 0.03125 (1/32) inches to about 0.5 [1/2] inches, but rear thickness 44 is typically about 0.125 (1/8) inches.

The rear surface 43 of projection 32 may also be beveled at an angle $\beta$ from the vertical. Angle $\beta$ may range from about 0 degrees to about 30 degrees, but typically about 16 degrees. According to aspects of the invention, projection 32 may have a length (not shown in FIG. 4 but, for example, extending into the plane of the page of FIG. 4) ranging from about 1 foot to about 200 feet, but is typically ranging from 50 feet to 100 feet, for example, about 80 feet, depending upon the width or circumference of the structure being covered.

Receptacle 34 having flange 35 is sized and shaped to receive projection 32 and retain projection or bead 32, for example, retained without separating under the loading typically expected upon cover 26 and panel 28. As shown in FIG. 4, receptacle 34 may be a hollow body 46 having an opening 48 and an internal cavity 50 adapted to receive projection 32. As shown in FIG. 4, opening 48 has a width 52, for example, a width adapted to receive at least the front thickness 42 of body 39 of projection 32. Accordingly, width 52 may be comparable to thickness 42, for example, ranging from about 0.03125 [1/32] inches to about 0.5 [1/2] inches, but width 52 may typically be about 0.07813 [5/64] inches. As also shown in FIG. 4, flange 35 may have a length 53 ranging from about 0.25 inches to about 3 feet, but length 53 is typically between about 0.50 inches and about 2 inches, for example, about 1 inch.

As shown in FIG. 4, body 46 of receptacle 34 may include two opposing arms 54 and 56, for example, resilient arms adapted to deflect, for example, elastically deflect, when receiving projection 32. Arms 54 and 56 may each include a projection 58, for example, cooperating projections, that when arms 54 and 56 elastically engage projection 32, at least one of arms 54 and 56 deflect when contacted by upper surface 40 and/or lower surface 41 of projection 32. According to aspects of the invention, at least one of arms 54 and 58 may continue to deflect with contact by upper surface 40 and/or lower surface 41 until the rear end of body 39 of projection 32 having thickness 44 passes through opening 48 allowing arms 54 and 56 to elastically contract. In one aspect, upon contraction of arms 54 and 56 at least one of the projections 58 on arms 54 and 56 are adapted to engage the rear surface 43 of projection 32. According to aspects of the invention, as shown most clearly in FIG. 3, when at least one of the projections 58 engage surface 43 of projection 32, the projection or bead 32 can be retained by receptacle 34 where panel 28 may be attached to cover 26.

In one aspect, receptacle 34 may include one or more ribs or projections 60 on an internal surface of cavity 50. In this aspect, the one or more ribs 60 may function to minimize or prevent the disengagement of projection 32 from receptacle 34. As shown most clearly in FIG. 3, with the elastic contraction of at least one of arms 54 and 56, and the engagement of at least one of projections 58 with rear surface 43 of bead 39, the one or more ribs 60 may contact or bear against the upper surface 40 and/or lower surface 41 of projection 32 and prevent rotation of projection 32, which may disengage a projection 58 from surface 43. However, according to this aspect of the invention, the presence of one or more ribs or projections 60 within cavity 50 of receptacle 34 may minimize or prevent rotation and disengagement of projection 32 from receptacle 34, and thus, ensure a secure connection of panel 28 to cover 26.

As shown in FIG. 4, body 46 of receptacle 34 may have thickness 62 ranging from about 1/4 inch to about 6 inches, but is typically between about 0.375 [⅜] inches and about 0.5 [½] inches, for example, 0.4375 [7/16] inches. Body 46 of receptacle 34 may have a width 64 ranging from about ¼ inch to about 6 inches, but is typically between about 0.375 [⅜] inches and about 0.75 [¾] inches, for example, 0.5625 [9/16] inches.

According to aspects of the invention, receptacle 34 may have a length (not shown in FIG. 4 but, for example, extending into the plane of the page of FIG. 4) ranging from about 1 inch to about 20 feet, but is typically ranging from 5 feet to 15 feet, for example, about 14 feet, depending upon the width of the structure being covered.

Projection 32 and receptacle 34 may be made from a broad range of materials, for example, from a plastic or from an elastomer. According to aspects of the invention projection 32 and receptacle 34 may be fabricated by any conventional methods, for example, in one aspect, projection 32 and receptacle 34 may be fabricated by extrusion.

Cover 26 and panel 28 may be made from a broad range of materials, for example, a plastic, for example, a woven or a non-woven plastic. In one aspect, cover 26 and panel 28 may be made from a vinyl or a woven plastic, for example, may comprise a material from which a tarp is made, for example, a polyester, a polyethylene, or their equivalent.

Figure 5:
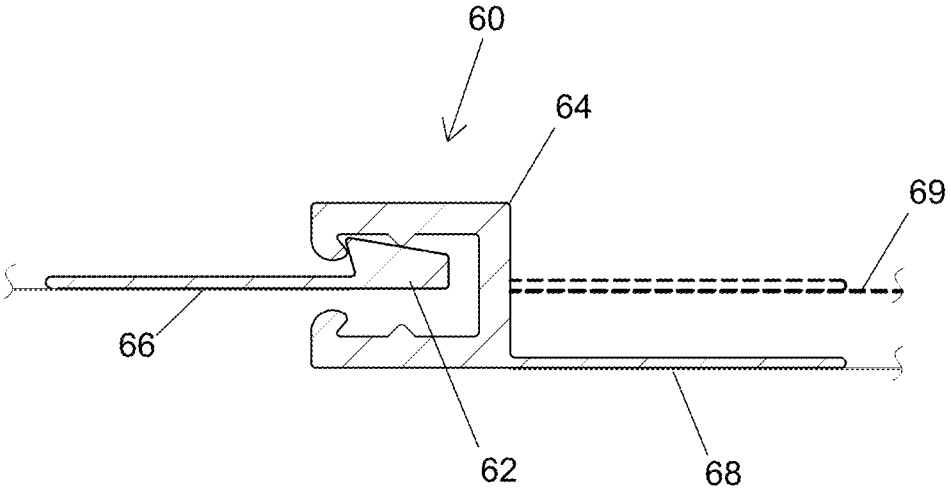
FIG. 5 is a cross-sectional view of a fastener according to another aspect of the invention.

FIG. 5 is a cross-sectional view of a fastener 60 according to another aspect of the invention. Similar to fastener 30, fastener 60 engages a recess-covering panel 68 with a cover or main panel 66, as disclosed herein. As shown in FIG. 5, fastener 60 comprises a male-type projection or "bead" 62 mounted to cover 66 and a female-type receptacle 64 mounted to panel 68. It is envisioned that in one aspect, male-type projection 62 may be mounted to panel 68 and a female-type receptacle 64 may be mounted to cover 66. The mounting of projection 32 to cover 26 or panel 28 and the mounting of receptacle 34 on panel 68 or cover 66 may be conventional, for example, projection 62 and receptacle 64 may be molded into cover 66 or panel 68, respectively, or attached by conventional fasteners.

In contrast to fastener 30 shown in FIGS. 3 and 4, fastener 60 shown in FIG. 5 includes a receptacle 64 comprising a generally rectangular shape in cross section, for example, having rounded corners, as shown. In addition, though in one aspect receptacle 64 shown in FIG. 5 may be centrally mounted to panel 68 (as shown in phantom by panel 69), panel 68 may be mounted offset from the centerline of receptacle 64, for example, mounted to an upper or lower extremity or edge of receptacle 64 as shown in FIG. 5. Otherwise, it is envisioned that projection or bead 62 and receptacle 64 may have any one or more of the attributes of projection 32 and receptacle 34 disclosed herein. For example, projection 62 and receptacle 64 may have any one of the dimensions disclosed for projection 32, and receptacle 64 may comprise any one or more of the materials of receptacle 34 disclosed herein.

It is believed that it will be clear from the above disclosure that the present invention, in its several embodiments and many aspects, provides unique opportunities to facilitate pool cover installation about peripheral recesses, such as, stairwells or stair assemblies, among other features and/or structures. According to aspects of the invention, swimming pool peripheral recess covers, methods for covering peripheral recesses in a swimming pool, and swimming pool peripheral recess cover fasteners are provided that overcome the disadvantages of the prior art. Though it is envisioned that aspects of the invention are uniquely adapted for use in swimming pools, including inground, partially inground, and above ground pools, it is also recognized that aspects of the invention may be used in any application having a peripheral recess, for example, in residential or commercial water features (for example, ornamental ponds and streams) and commercial or industrial vessels or tanks, among other structures. Other applications of aspects of he invention will be apparent to those skilled in the art.

The terminology used herein is provided for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The invention claimed is:

1. A swimming pool peripheral recess cover fastener adapted for use with a peripheral recess having a width, the width extending from a first end of the peripheral recess to a second end, opposite the first end, the fastener comprising:

an elongated receptacle, the elongated receptacle extending across the width of the peripheral recess and having an elongated opening defined by opposing elongated flexible arms and an internal cavity in communication with the opening, the internal cavity adapted to receive and retain a mating projection mounted on a main pool cover; and an elongated flange extending from the elongated receptacle opposite the elongated opening, the elongated flange adapted to be mounted to a peripheral recess cover.

2. The fastener as recited in claim 1, wherein the opposing elongated flexible arms comprise arms, each of the arms having a free end adapted to deflect when contacted by the mating projection.

3. The fastener as recited in claim 2, wherein each of the opposing arms further comprises a projection adapted to engage the mating projection.

4. The fastener as recited in claim 1, wherein the internal cavity comprises an internal surface having at least one rib adapted to contact the mating projection and minimize rotation of the mating projection.

5. The fastener as recited in claim 1, wherein the fastener comprises an elastomeric fastener.

6. The fastener as recited in claim 1, wherein the peripheral recess comprises a stair assembly.

7. The fastener as recited in claim 1, wherein the elongated receptacle comprises an elongated receptacle molded to the elongated flange.

8. The fastener as recited in claim 1, wherein the mating projection mounted on the main pool comprises a bead.

9. The fastener as recited in claim 1, wherein the main pool cover comprises a winter cover.

10. A swimming pool peripheral recess cover fastener adapted for use with a peripheral recess having a width, the width extending from a first end of the peripheral recess to a second end, opposite the first end, the fastener comprising:

an elongated projection, the elongated projection having a free end, extending across the width of the peripheral recess, and adapted to be received and retained by a mating elongated recess mounted on a main pool cover; and an elongated flange extending from the elongated projection opposite the free end, the elongated flange adapted to be mounted to a peripheral recess cover.

11. The fastener as recited in claim 10, wherein the elongated projection comprises an elongated body having an upper surface and a lower surface, and wherein at least one of the upper surface and the lower surface is beveled.

12. The fastener as recited in claim 10, wherein the fastener comprises an elastomeric fastener.

13. The fastener as recited in claim 10, wherein the peripheral recess comprises a stair assembly.

14. The fastener as recited in claim 10, wherein the elongated projection comprises a bead.

15. The fastener as recited in claim 10, wherein the main pool cover comprises a winter cover.

16. The fastener as recited in claim 1, wherein the elongated flange comprises a thickness between 0.025 inches and 0.050 inches.

17. The fastener as recited in claim 1, wherein the first end and the second end of the peripheral recess each comprise a lateral extremity of the peripheral recess.

18. The fastener as recited in claim 1, wherein the first end and the second end of the peripheral recess each comprise a side wall of the peripheral recess.

19. The fastener as recited in claim 10, wherein the first end and the second end of the peripheral recess each comprise a lateral extremity of the peripheral recess.

20. The fastener as recited in claim 10, wherein the first end and the second end of the peripheral recess each comprise a side wall of the peripheral recess.

* * * * *